United States Patent [19]

Still et al.

[11] 4,083,416

[45] Apr. 11, 1978

[54] COLLAPSIBLE CUTTERHEAD FOR DRILLING UPWARD

[75] Inventors: Norman H. Still; Robert W. Berry, Jr., both of Brea, Calif.

[73] Assignee: Smith International, Inc., Newport Beach, Calif.

[21] Appl. No.: 787,283

[22] Filed: Apr. 13, 1977

[51] Int. Cl.[2] ..... E21B 9/00

[52] U.S. Cl. ..... 175/263; 175/171; 175/258

[58] Field of Search ..... 175/263, 258, 171, 265

[56] References Cited

U.S. PATENT DOCUMENTS

| | | | |
|---|---|---|---|
| 1,571,309 | 2/1926 | Wall | 175/263 |
| 2,588,068 | 3/1952 | Williams et al. | 175/171 X |
| 2,705,129 | 3/1955 | Menton et al. | 175/263 |
| 4,031,972 | 6/1977 | Burg | 175/263 |

*Primary Examiner*—Ernest R. Purser
*Assistant Examiner*—William F. Pate, III

[57] ABSTRACT

A cutterhead adapted for drilling a hole upwardly in the earth, and to then be withdrawn downwardly through a casing which is inserted underneath the cutterhead, characterized by gauge cutters which are pivotally mounted on the cutterhead so that they will pivot upward and radially inward when the cutterhead is drawn into the casing, and also characterized by stabilizer rollers mounted on removable frames that can be detached.

8 Claims, 7 Drawing Figures

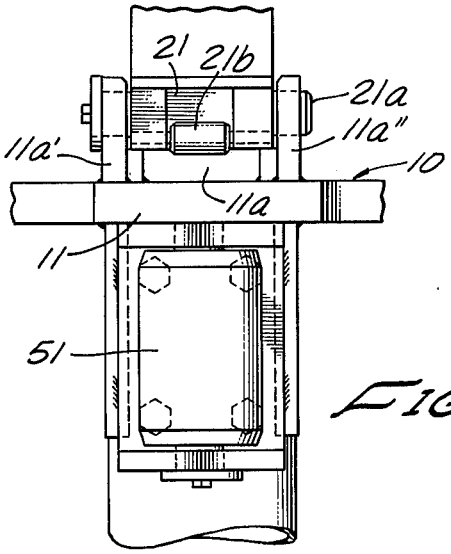
FIG. 3.
FIG. 4.
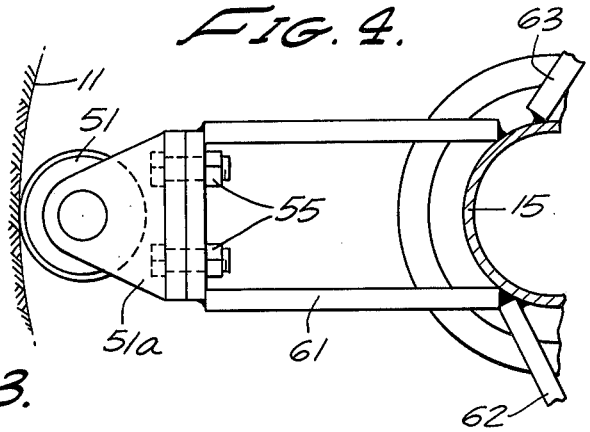
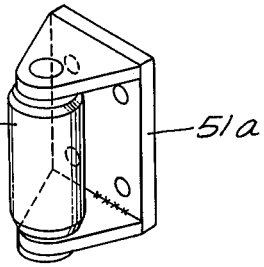
FIG. 5.
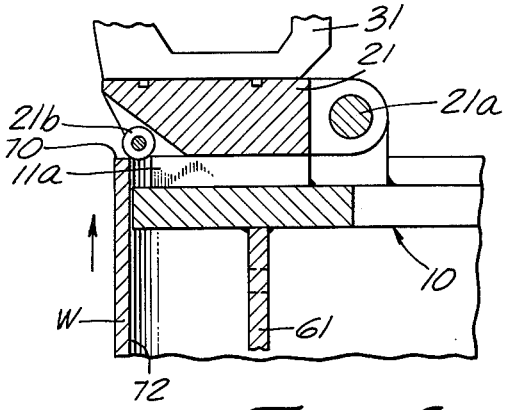
FIG. 6.
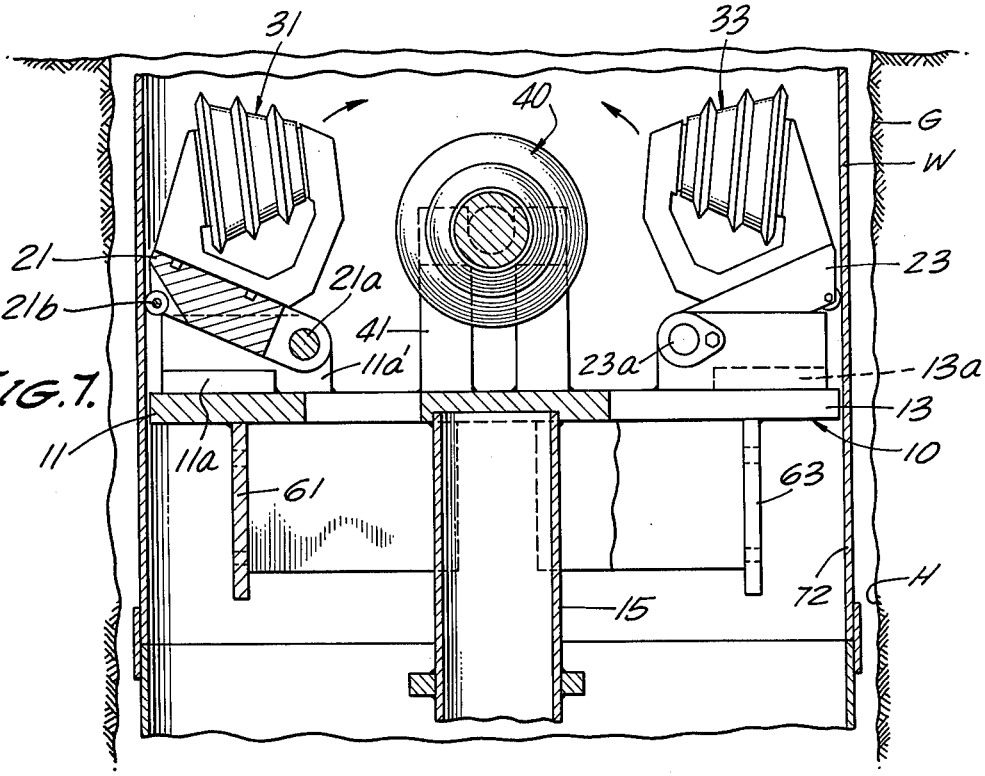
FIG. 7.

COLLAPSIBLE CUTTERHEAD FOR DRILLING UPWARD

BACKGROUND OF THE INVENTION

Many aspects of the technical problems of drilling holes in the earth are the same whether the hole is being drilled downwardly, or horizontally, or upwardly. But some aspects of the procedure are significantly different, depending upon which kind of drilling is being done.

In underground mines it is a common practice to drill vertical access holes between horizontal tunnels that are on different levels. These holes or shafts need to be of sufficient diameter for the passage therethrough of men and materials, and typically have a diameter of about four feet after a metal casing has been inserted into the hole. In drilling such holes it is not uncommon to encounter soft or "bad" ground. We have therefore invented a novel method for casing the upwardly drilled hole more or less concurrently with the drilling thereof.

In some instances, however, after a considerable portion of the upwardly extending hole has been drilled, it is necessary to withdraw the cutterhead downward through the cased portion of the hole. For that purpose we have provided a collapsible cutterhead.

Thus the object and purpose of the present invention is to provide a collapsible cutterhead for drilling upward, and which will be suitable for use in carrying out our other invention as previously referred to.

SUMMARY OF THE INVENTION

According to the present invention a cutterhead is provided with a generally circular frame having a diameter less than that of the interior wall of the casing for the hole. At least three gauge cutters are placed upon the upper side of the cutterhead frame in circumferentially spaced positions thereon. The gauge cutters normally extend radially outward beyond the cutterhead frame, so that the hole will be drilled to a large enough diameter to later receive the casing. Each gauge cutter on its radially inward extremity is pivotally secured to the cutterhead frame, so that the outer extremity of the gauge cutter may be pivoted upwardly and inwardly in a vertical plane which is radial to the frame.

During upward drilling operations the gauge cutters are kept in their downward and radially extending positions, both by their own weight and by downward pressure from the end face of the hole. When the cutterhead is retracted downward, however, the gauge cutters pivot upwardly and inwardly, reducing the effective diameter of the cutterhead so that it may be withdrawn through the casing.

The novel cutterhead of the present invention is also provided with stabilizer rollers supported upon removable frames, and these stabilizer rollers and their removable frames may be detached when the cutterhead is withdrawn downwardly and out of the hole.

According to our novel mining method it may sometimes be necessary to raise the cutterhead upward inside the cased hole. According to the present invention cutter rollers are pivotally mounted at the lower and outward extremities of the gauge cutters. The arrangement and the operation of these rollers is such that when the cutterhead is raised upward inside the casing, the various gauge cutters, despite their weight and the force of gravity, nevertheless remain in their vertically raised and hence radially retracted positions.

DRAWING SUMMARY

FIG. 3 is an elevation detail of a single stabilizer roller and gauge cutter, taken on line 3—3 of FIG. 2;

FIG. 4 is a top plan view of a stabilizer roller and its removable bracket taken on the line 4—4 of FIG. 2;

FIG. 5 is a perspective view of a stabilizer roller and its removable bracket;

FIG. 6 is a fragmentary elevational cross-sectional view showing the position of one of the gauge cutters as the cutterhead is being withdrawn downward into the casing; and FIG. 7 is an elevational view, partially in cross-section, showing the cutterhead located within the casing.

PREFERRED EMBODIMENT (FIGS. 1–7)

Figure 1:
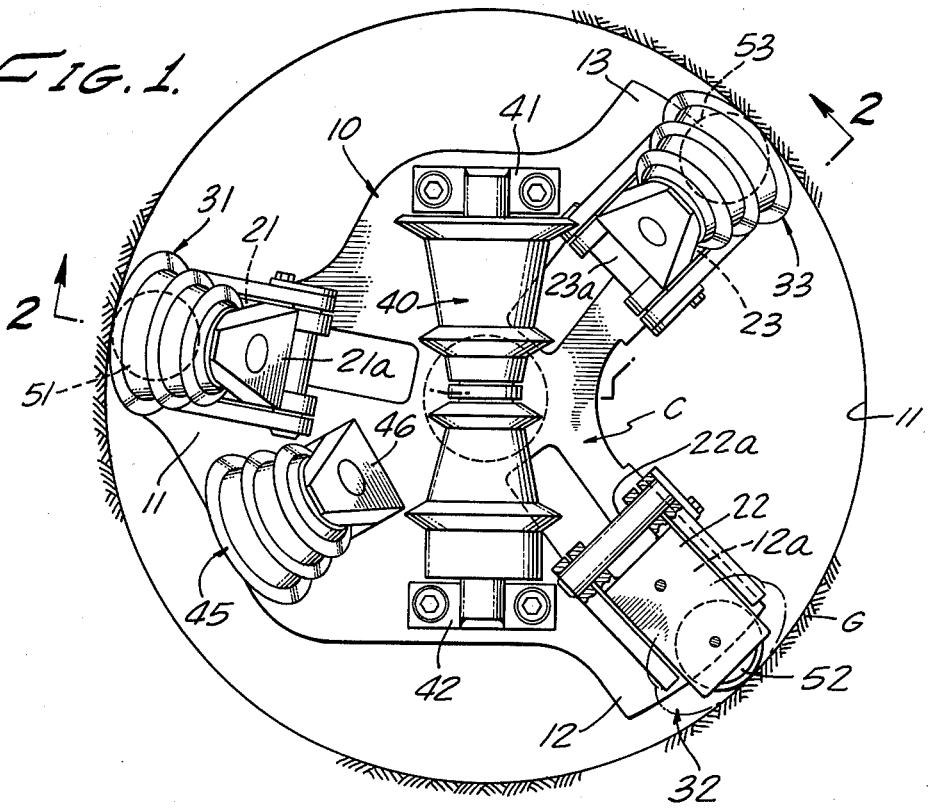
FIG. 1 is a top plan view of the cutterhead of the present invention, located within a hole that is being drilled upwardly.
Figure 2:
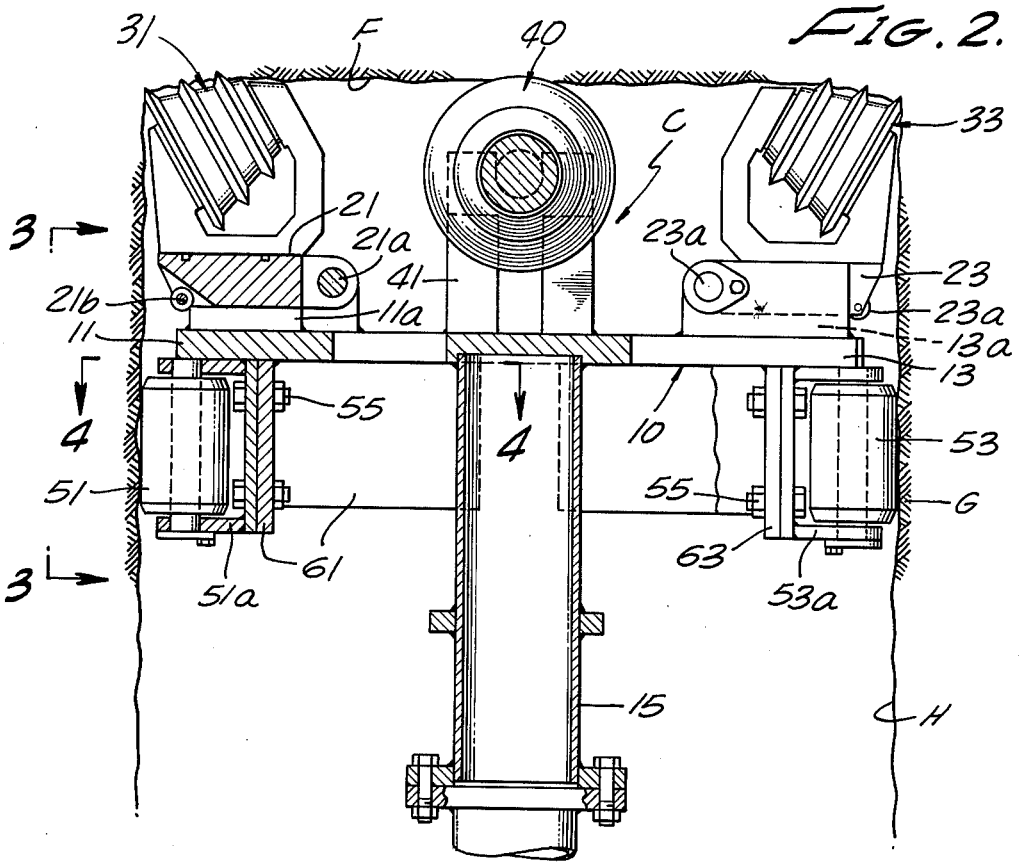
FIG. 2 is an elevation view, partly in section, taken on line 2—2 of FIG. 1.

Reference is now made to FIGS. 1–7 of the drawings illustrating the presently preferred embodiment of the invention. As best seen in FIG. 2, a cutterhead C is both rotatably and upwardly driven in order to drill a hole H in the ground or earth G. The hole is extended upwardly by cutting away the material on its end face or upper end surface F. Initially the circumferential wall of the hole H is bare earth, but later a casing W (FIGS. 6 and 7) is inserted into the hole underneath the cutterhead.

Cutterhead C includes a central frame 10 which is, very roughly speaking, generally circular in its configuration. The central frame 10 consists primarily of a flat plate which is horizontally disposed, having a central portion which is relatively small compared to the diameter of the hole H and having three arms 11, 12, 13 which project radially outwardly. The maximum diameter of the frame 10, as measured at the extremities of the arms 11, 12, 13 is less than the interior diameter of casing W. Gauge cutters 31, 32, 33 are mounted upon the frame arms 11, 12, 13, respectively. A center cutter 40 is disposed upon the upper surface of the central portion of frame 10 and is secured at its ends by means of attachment brackets 41, 42, respectively. An inner cutter 45 (seen only in FIG. 1) is also secured to the upper surface of frame 10 by means of a bracket 46.

During the drilling operation the gauge cutters 31, 32, 33 cut the radially outward portion of the hole face F, as best seen in FIG. 2. At the same time they also cut or gauge the circumferential side wall of the hole H to a desired diameter. Center cutter 40 cuts the central portion of end face F. Inner cutter 45 cuts that portion of the end face which lies inside the path of the gauge cutters but outside the path of the center cutter. This general arrangement of cutting elements in a cutterhead is already known in the art and does not, in and of itself, constitute the novel features of the present invention.

A drill stem section 15 is arranged concentric to the cutterhead frame 10 with the upper end of the drill stem section being secured to the under surface of the frame. Drill stem section 15 therefore provides the means both for raising and lowering the cutterhead, and also for providing it with rotatable drive when drilling operations are being conducted. This feature of the cutterhead assembly is also well known in the art.

An important feature of the present invention is the provision of gauge cutter brackets 21, 22, 23 upon which the respective gauge cutters are mounted. In FIG. 1 the gauge cutter 32 is omitted so that its supporting bracket 22 may be seen. Each of the gauge cutter brackets at its radially inward end is pivotally secured to the cutter frame 10. Thus the bracket 22 is supported on a pivot shaft 22*a* which extends horizontally, and is also perpendicular to a vertical plane that would pass through the center of gauge cutter 32 and which lies radial to the cutterhead frame 10. In similar fashion the radially inner end of gauge cutter bracket 21 is pivotally supported on a pivot shaft 21*a*, as clearly seen in FIG. 2.

Each of the frame arms 11, 12, 13 is equipped with a bracket rest 11*a*, 12*a*, 13*a*, respectively. Each bracket rest such as 11*a* includes a flat plate which rests on top of the arm 11 of frame plate 10, and also includes a pair of vertically extending side plates 11*a'*, 11*a''* (see FIG. 3). Each cutter bracket rest therefore provides a vertical support for the associated bracket, and at the same time its vertical side plates such as 11*a'*, 11*a''* receive the ends of the pivot shaft such as 21*a*. A secure vertical support is therefore provided for driving each gauge cutter upward against the end face F of the hole. At the same time each gauge cutter bracket is supported against any significant twisting movement which might tend to occur as a result of the driven rotation of the cutterhead assembly. And quite significantly, each gauge cutter bracket is also pivotally supported at the lower and radially inward extremity of the cutter so that the outer extremity of the cutter may be pivoted upwardly and inwardly in a vertical place which is radial to the cutterhead frame 10.

Each gauge cutter bracket also carries a small roller at its lower and radially outward extremity. The roller 21*b* carried on the cutter bracket 21 is best seen in FIGS. 2 and 3. The function of roller 21*b* is illustrated in FIGS. 6 and 7. FIG. 6 shows the cutterhead being withdrawn downwardly, or casing W being driven upward around it.

Three stabilizer rollers 51, 52, 53 are supported on removable brackets 51*a*, 52*a*, 53*a*, respectively. The stabilizer roller 51 and its supporting bracket 51*a* are shown in FIGS. 2, 3, and 4, and are also shown in perspective in FIG. 5. The removable brackets 51*a*, 52*a*, 53*a* are secured to permanent brackets 61, 62, 63, respectively. The structure of the bracket 61 is best seen in FIGS. 2 and 4, showing that it is secured by welding to the external surface of drill stem section 15 and also by welding to the under surface of the cutterhead frame plate 10.

In operation, the stabilizer rollers 51, 52, 53 lie at substantially the same radius distance from the axis of rotation of the cutterhead assembly as do the outermost cutting edges of the gauge cutters 31, 32, 33. When the upwardly drill hole is being extended, therefore, the stabilizer rollers provide alignment and stability of the cutterhead assembly within the hole. It is also significant to note, as best seen in FIG. 3, that each stabilizing roller lies directly beneath a corresponding one of the gauge cutters, thereby providing maximum strength and rigidity of support.

The stabilizer rollers are particularly useful when cutting the initial part of the hole, such as the first 12 to 16 feet. It is then desirable to withdraw the cutterhead downwardly and out of the hole. The removable brackets 51*a*, 52*a*, 53*a* which support the stabilizer rollers are detached by removing the bolts 55 which secure each removable bracket to its associated fixed bracket. These bolts are accessible through the hollow interior of each fixed bracket 61, 62, and 63.

According to the present method of utilizing the invention, the initial 12 to 16 feet of the hole is cut without installing any casing, and the cutterhead is withdrawn from the hole for purpose of removing the stabilizer rollers. The cutterhead is then reinserted into the hole in order to continue the upward drilling. Casing W is then driven upwardly in the hole beneath the cutterhead. It may later become necessary to withdraw the cutterhead through the interior of the casing, and if so, the pivotal supports of the gauge cutters will operate in the manner illustrated in FIGS. 6 and 7.

When the cutterhead is partially withdrawn inside the casing, the cutter rollers 21*b*, 22*b*, 23*b* engage the upper end face 70 of the casing, as shown in FIG. 6. This contact causes each gauge cutter bracket 21, 22, 23 and its associated cutter 31, 32, 33 to pivot upwardly and inwardly to the position shown in FIG. 7. As the cutterhead assembly continues to be lowered, the cutter rollers roll downwardly on the interior wall surface 72 of the casing.

In some instances it is necessary to raise the cutterhead through a portion of the hole that has already been cased. The gauge cutters are pivoted upwardly and inwardly through a sufficient angle so that, as shown in FIG. 7, the cutter rollers will roll upwardly on the casing wall and provide a non-binding support for the respective gauge cutter.

ALTERNATE FORMS

While the presently preferred embodiment of our novel cutterhead assembly includes only three gauge cutters, it will nevertheless be understood that a greater number of gauge cutters may be utilized if so desired. Also, a number of stabilizer rollers greater than three may be utilized if so desired.

Other modifications and changes within the scope of the invention will be readily apparent to those skilled in the art.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. A cutterhead adapted to drill a hole upwardly in the earth, and then when a casing is inserted into the hole beneath the cutterhead, to be withdrawn downwardly into and through the casing and hence out of the hole, said cutterhead comprising:

a generally circular cutterhead frame whose horizontal diameter is less than the interior diameter of the casing;

means provided on the underside of said cutterhead frame for drivingly rotating the same;

at least three gauge cutters disposed on the upper side of said cutterhead frame in substantially equally spaced positions about the periphery thereof;

at least one additional cutter carried upon the upper surface of said cutterhead frame between said gauge cutters for cutting the end face of the hole;

each of said gauge cutters having its radially inward extremity pivotally supported from said cutterhead frame and normally extending radially outward beyond said frame, whereby the outer extremity of said gauge cutter may be pivoted upwardly and inwardly in a vertical plane radial to said frame; and at least three stabilizer rollers mounted on respective roller frames, said roller frames being removably attached to the underside of said cutterhead frame in circumferentially spaced positions thereon so that each stabilizer roller extends radially beyond said cutterhead frame and is supported for rotation about a vertical axis.

2. A cutterhead as in claim 1 which further includes at least three cutter rollers, one for each of said gauge cutters, each roller being pivotally mounted at the lower and outward extremity of the associated gauge cutter so that when the cutterhead moves downwardly within the casing, the roller rolls vertically along the interior wall of the casing.

3. A cutterhead as in claim 1 wherein each of said stabilizer roller frames is located directly beneath a corresponding one of said gauge cutters.

4. Apparatus for upward drilling comprising:

a cylindrical casing;

a generally circular cutterhead frame disposed transversely of said casing;

three gauge cutters disposed in radial planes relative to said cutterhead frame and spaced at circumferential intervals thereon of about 120°, the inner and lower corner of each cutter being pivotally secured to said frame;

said cutters being pivoted upwardly and inwardly from their normal cutting positions; and cutter rollers carried on the outer and lower extremity of corresponding cutters and rollingly engaging the inner surface of said casing to facilitate longitudinal movement of said cutterhead frame and cutters therein.

5. A collapsible cutterhead for upward drilling, comprising:

a generally circular cutterhead frame;

means for drivingly rotating said frame;

three radially extending gauge cutters disposed in substantially equally spaced circumferential positions about said frame and extending radially beyond said frame;

means pivotally supporting each of said cutters at its lower and inner corner from said frame; and roller means at the lower and outer corner of each of said cutters for supporting said cutter in a pivotally raised position when the cutterhead moves longitudinally within a casing whose interior diameter is less than the diameter of a hole cut by the cutterhead.

6. A collapsible cutterhead for upward drilling, comprising:

a generally circular frame having three bracket rests circumferentially spaced on its upper surface at about 120° intervals;

means for drivingly rotating said frame;

three radially extending brackets normally supported in horizontal positions on corresponding ones of said bracket rests, each bracket having its inner end pivotally attached to the bracket rest;

three gauge cutters supported upon and secured to corresponding ones of said brackets, and normally extending radially beyond said frame, said gauge cutters being operable when said frame is rotating for cutting the end face of an upwardly extending hole while concurrently gauging the side wall thereof;

whereby said brackets and cutters may be pivotally raised upwardly and inwardly in order to draw the cutterhead within a casing whose interior diameter is less than the diameter of said hole; and three cutter rollers carried by corresponding ones of said brackets, each roller being mounted at the outer and lower extremity of the associated bracket for rotation about a horizontal axis so as to roll longitudinally of the casing while supporting the associated bracket and cutter in their raised position.

7. A collapsible cutterhead for upward drilling, comprising:

a set of three gauge cutters arranged at intervals of about 120° along the circumference of a circle, being normally disposed to cut the end face of an upwardly extending hole and at the same time to gauge the side wall thereof;

a central frame;

a set of three cutter brackets, one for each gauge cutter, each of said brackets being secured underneath the respectively associated cutter and having its radially inward extremity pivotally attached to said frame;

at least one additional cutter carried by said frame and disposed between said gauge cutters, for cutting said end face;

a set of three cutter rollers having horizontal axes of rotation, one of said rollers being carried on the underside of each of said cutter brackets near the radially outward extremity thereof, whereby said cutter brackets and gauge cutters may pivot upwardly and inwardly so as to fit within a casing and said cutter rollers will then engage the interior surface of the casing and roll therealong; and detachable stabilizer roller means carried by said frame for rollingly engaging the side wall of the hole when said frame rotates therein.

8. A cutterhead as in claim 7 wherein said stabilizer roller means includes at least three stabilizer rollers, a separate removable bracket supporting each roller, a separate fixed bracket supporting each removable bracket, and removable fastening means securing the removable bracket to the fixed bracket; said fixed bracket being hollow and said removable fastening means being accessible from the interior thereof.

* * * * *